US011342097B2

(12) United States Patent
Farkas et al.

(10) Patent No.: US 11,342,097 B2
(45) Date of Patent: May 24, 2022

(54) SPIRAL SHIELDING ON A HIGH SPEED CABLE

(71) Applicant: DELL PRODUCTS, LP, Round Rock, TX (US)

(72) Inventors: Sandor Farkas, Round Rock, TX (US); Bhyrav M. Mutnury, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 16/983,489

(22) Filed: Aug. 3, 2020

(65) Prior Publication Data

US 2022/0037057 A1 Feb. 3, 2022

(51) Int. Cl.
*H01B 13/26* (2006.01)
*H01B 11/18* (2006.01)
*H01B 13/00* (2006.01)

(52) U.S. Cl.
CPC ..... *H01B 11/1895* (2013.01); *H01B 13/0036* (2013.01); *H01B 13/26* (2013.01)

(58) Field of Classification Search
CPC . H01B 11/1895; H01B 13/0036; H01B 13/26
USPC ..... 174/108
See application file for complete search history.

(56) References Cited

U.S. PATENT DOCUMENTS 4,323,721 A * 4/1982 Kincaid ..... H01B 11/06 428/189
5,416,268 A * 5/1995 Ellis ..... H01B 11/1016 174/102 R
6,740,808 B1 * 5/2004 Chang ..... H01B 7/0861 174/113 R
7,525,045 B2 * 4/2009 Archambeault ..... H01P 3/06 174/102 R
7,649,142 B2 * 1/2010 Archambeault ..... H01P 1/2005 174/102 R
8,552,291 B2 * 10/2013 Lingambudi ..... H01B 11/203 174/117 F
9,159,472 B2 * 10/2015 Nordin ..... H05K 9/0081
9,349,507 B2 * 5/2016 Vu ..... H01B 11/1025
10,424,420 B1 9/2019 Farkas et al.
10,573,434 B2 * 2/2020 Kobayashi ..... H01B 11/1895
2004/0017264 A1 * 1/2004 Chang ..... H01B 11/002 333/1
2004/0026101 A1 * 2/2004 Ochi ..... H01B 11/1091 174/36
2004/0168821 A1 9/2004 Goto
2008/0308293 A1 * 12/2008 Archambeault ..... H01P 3/06 174/102 R
2009/0229850 A1 * 9/2009 Cases ..... H01B 11/20 156/53
2011/0247856 A1 * 10/2011 Matsuda ..... H01B 11/203 174/108

(Continued)

*Primary Examiner* — Timothy J Thompson
*Assistant Examiner* — Michael F Mcallister
(74) *Attorney, Agent, or Firm* — Larson Newman, LLP

(57) ABSTRACT

A dual axial cable includes first and second signal conductors and a shield. The first and second signal conductors transmit a differential signal. The shield includes a foil wrap spirally wrapped around the first and second conductors to form a plurality of foil wrap sections. Each of the foil wrap sections overlaps an adjacent foil wrap section. The periodicity of a pitch of each of the overlaps varies along a length of the dual axial cable.

20 Claims, 4 Drawing Sheets

(56) References Cited

U.S. PATENT DOCUMENTS

| | | | | |
|---|---|---|---|---|
| 2011/0290524 | A1* | 12/2011 | Lingambudi | H01B 11/203 174/102 R |
| 2012/0024566 | A1* | 2/2012 | Shimosawa | H01B 11/1091 174/107 |
| 2012/0145429 | A1 | 6/2012 | Nordin et al. | |
| 2012/0227998 | A1* | 9/2012 | Lindstrom | H01B 11/1025 174/103 |
| 2014/0124236 | A1* | 5/2014 | Vu | H01B 11/1025 174/106 R |
| 2015/0318082 | A1* | 11/2015 | Farkas | H01B 11/1091 361/679.02 |
| 2016/0073559 | A1* | 3/2016 | Nordin | H01B 11/20 174/34 |
| 2018/0090243 | A1* | 3/2018 | Farkas | H01B 11/002 |

* cited by examiner

SPIRAL SHIELDING ON A HIGH SPEED CABLE

FIELD OF THE DISCLOSURE

This disclosure generally relates to information handling systems, and more particularly relates to spiral shielding on a high speed cable.

BACKGROUND

As the value and use of information continues to increase, individuals and businesses seek additional ways to process and store information. One option is an information handling system. An information handling system generally processes, compiles, stores, and/or communicates information or data for business, personal, or other purposes. Because technology and information handling needs and requirements may vary between different applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, reservations, enterprise data storage, or global communications. In addition, information handling systems may include a variety of hardware and software resources that may be configured to process, store, and communicate information and may include one or more computer systems, data storage systems, and networking systems.

SUMMARY

A dual axial cable includes first and second signal conductors and a shield. The first and second signal conductors may transmit a differential signal. The shield includes a foil wrap spirally wrapped around the first and second conductors to form a plurality of foil wrap sections. Each of the foil wrap sections may overlap an adjacent foil wrap section. The periodicity of a pitch of each of the overlaps may vary along a length of the dual axial cable.

BRIEF DESCRIPTION OF THE DRAWINGS

It will be appreciated that for simplicity and clarity of illustration, elements illustrated in the Figures have not necessarily been drawn to scale. For example, the dimensions of some of the elements are exaggerated relative to other elements. Embodiments incorporating teachings of the present disclosure are shown and described with respect to the drawings presented herein, in which.

The use of the same reference symbols in different drawings indicates similar or identical items.

DETAILED DESCRIPTION OF DRAWINGS

The following description in combination with the Figures is provided to assist in understanding the teachings disclosed herein. The following discussion will focus on specific implementations and embodiments of the teachings. This focus is provided to assist in describing the teachings, and should not be interpreted as a limitation on the scope or applicability of the teachings. However, other teachings may certainly be used in this application. The teachings may also be used in other applications, and with several different types of architectures, such as distributed computing architectures, client/server architectures, or middleware server architectures and associated resources.

As the speed of high speed cables increases, an overlap of a shield wrapped around a dual axial cable may generate a resonance characteristic that may limit performance of the high speed cable.

Figure 1:
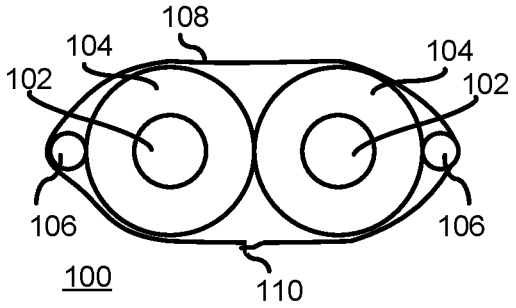
FIG. 1 is schematic cross-sectional view of a dual axial cable according to an embodiment of the present disclosure.

FIG. 1 illustrates an embodiment of a dual axial cable 100 of an information handling system. For the purpose of this disclosure an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a laptop computer, a smart phone, a tablet device or other consumer electronic device, a network server, a network storage device, a switch router or other network communication device, or any other suitable device and may vary in size, shape, performance, functionality, and price. Further, an information handling system may include processing resources for executing machine-executable code, such as a central processing unit (CPU), a programmable logic array (PLA), an embedded device such as a System-on-a-Chip (SoC), or other control logic hardware. An information handling system may also include one or more computer-readable medium for storing machine-executable code, such as software or data. Additional components of an information handling system may include one or more storage devices that may store machine-executable code, one or more communications ports for communicating with external devices, and various input and output (I/O) devices, such as a keyboard, a mouse, and a video display. An information handling system may also include one or more buses operable to transmit information between the various hardware components.

Dual axial cable 100 includes conductors 102, insulators 104, drain wires 106, and a shield 108. Conductors 102 combine to provide the dual axial cable 100 with the ability to transmit differential signals. Each of the conductors 102 are surrounded by an insulator 104. In an embodiment, drain wires 106 are grounded. While two drain wires 106 are shown in FIG. 1, dual axial cable 100 may include only a single drain wire without varying from the scope of this disclosure.

Dual axial conductors 102 may transmit signals for different transmission protocols, such as serial attached small computer system interface (SCSI) (SAS), InfiniBand, serial AT attachment (SATA), peripheral component interconnect express (PCIe), ultra path interconnect (UPI), double speed fibre channel, synchronous optical networking (SONET)/synchronous digital hierarchy (SDH) (SONET/SDH), high speed copper, 10 GbE, or the like. Dual axial cable 100 may be an integral part of the design in an information handling system, such as a server. For example, within a server rack, one or multiple servers may be installed and communication between the racks may be accomplished through cables, such as dual axial cable 100. Additionally, one or more dual axial cables 100 may be utilized to connect one or more printed circuit boards (PCBs) within an individual server. Signals speeds within cables, such as dual axial cable 100, double every generation, such that signal integrity sensitivity to parasitic effects is also increasing. For example, the spirally wrapping of shield 108 generates a resonance or 'suck-out" effect. In this example, the periodic overlap 100 of shield 108 may create a periodic return path discontinuity resulting in a resonance or suck-out. The resonance or suck-out becomes more of a problem as signal speed in dual axial cable 100 increases. Therefore, dual axial cable 100 improves an information handling system by reducing an intensity of the resonance and suck-out of signals within the information handling system as described herein.

Conductors 102 are shielded with shield 108 that is spirally wrapped around cable 100. For example, shield 108 includes a thin sheet of aluminum metal laminated upon an insulating substrate, such as polyethylene plastic. Shield 108 may be tightly wrapped around the conductors 102, insulators 104, and the drain wire 106. As shield 108 is spirally wrapped, each turn of the shield around cable 100 may form an overlap 110 on top of the previous turn. While only a single overlap 110 is shown in FIG. 1, cable 100 may include multiple overlaps as shown in FIGS. 2 and 3 below.

Figure 2:
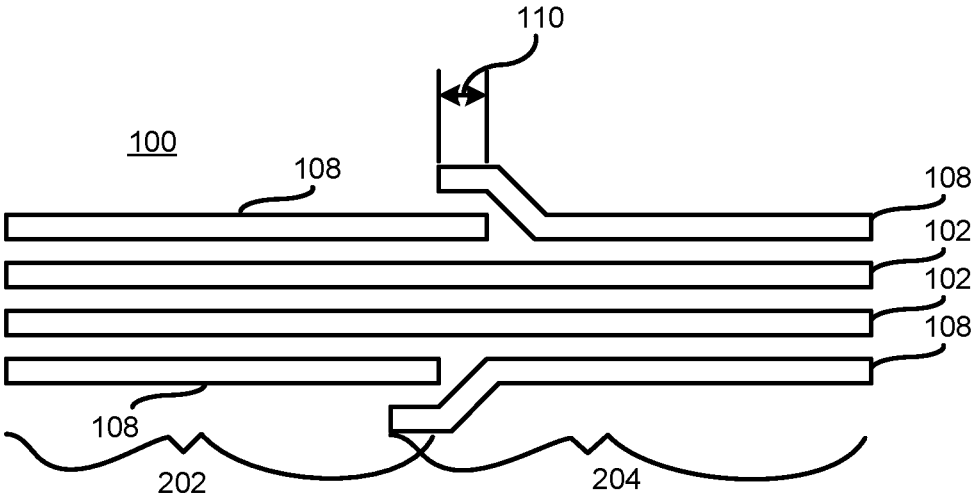
FIG. 2 is a diagram of a representation of a shield construction for the dual axial cable according to an embodiment of the present disclosure.

FIG. 2 is a diagram of a representation of a shield construction for a dual axial cable 100 according to an embodiment of the present disclosure. Dual axial cable 100 includes wires 102 and shield 108. In an example, wires 102 may transmit differential signals, such that one wire transmits a positive signal and the other wire transmits a negative signal. In certain examples, shield 108 may be formed by a single foil wrap that may be spirally wrapped around the wires, and each rotation around the wires may create an overlap 110 on top of the previous portion of the foil wrap. For example, one section of the foil wrap on dual axial cable 100 may be defined as a turn 202, and another section of the foil wrap may be defined as a turn 204. In this example, section or turn 202 of the foil wrap of shield 108 may be placed in physical communication with dual axial cable 100, and section or turn 204 may be the next subsequent portion of the foil wrap placed in physical communication with the dual axial cable. As shown in FIG. 2, turn 204 may create an overlap 110 on top of turn 202.

In an example, a return current from wires 102 may travel on spiral shield 110. However, each overlap 110 operates as an inductor/capacitor (LC) circuit. In previous dual axial cables, multiple overlaps 110 may periodically cascaded over the length of the cable with a constant period. In an example, the resonance frequency of the LC circuit within shield 108 may be based on the capacitance formed by the gap in overlap 110 and the inductance of the foil wrap of shield 108. The multiple overlaps 110 periodically cascading over the length of the cable with a constant period may cause an amplitude of a resonator to increase, which in turn results is a sharp unwanted frequency response. Multiple overlaps 110 of foil wrap of shield 108 over the length of dual axial cable 100 may cause a suck-out effect, which in turn would impact high speed signaling. However, overlap 110 may not be reduced to zero because it could result in potential danger of radiation of signals and discontinuity in the current return path. Therefore, dual axial cable 100 may be improved by controlling the periodic repetitive nature of overlap 110 in shield 108.

Figure 3:
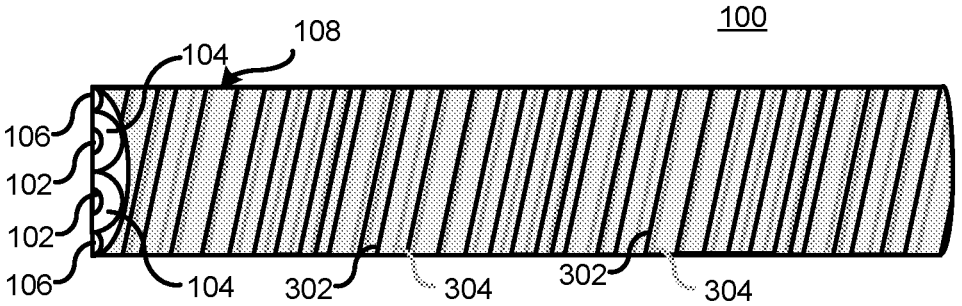
FIG. 3 is schematic top view of the dual axial cable with a slanted cut at one end of the dual axial cable according to an embodiment of the present disclosure.

FIG. 3 is schematic top view of dual axial cable 100 according to an embodiment of the present disclosure. As stated above, shield 108 includes a thin sheet of aluminum metal laminated upon an insulating substrate, such as polyethylene plastic. Shield 108 may be tightly wrapped around conductors 102, insulators 104, and drain wires 106. The wrapping of shield 108 may keep the conductors 102 together to maintain characteristic impedance for the cable 100, to get good return loss performance, and to provide a low resistive contact between the drain wire 110 and the shield 108. Each strip or section of shield 108 wrapped around cable 100 may overlap the previous strip of the shield 108. For example, the darker lines 302 illustrate a top layer of shield 108, and the lighter lines 304 illustrate a bottom layer of the shield. However, shield 108 being spirally wrapped around conductors 102 may cause a resonance characteristic to occur in cable 100.

Figure 4:
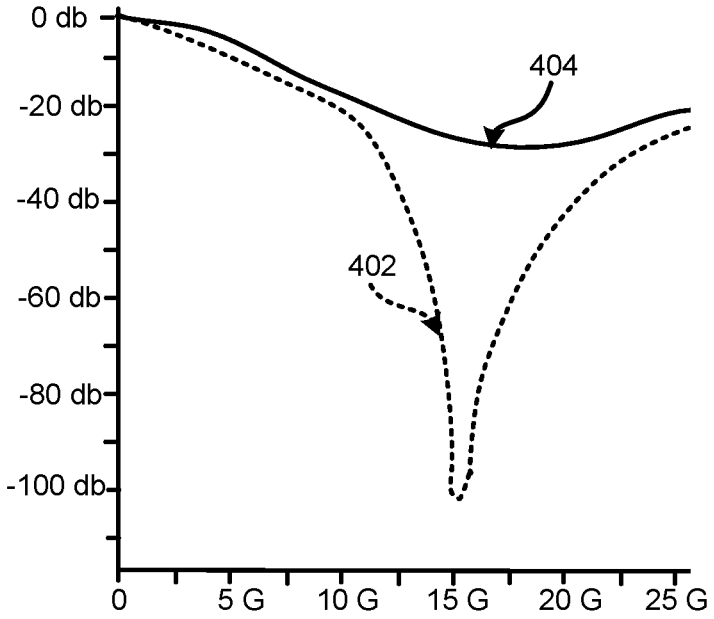
FIG. 4 illustrates frequency responses associated with the dual axial cable of FIGS. 1, 2, and 3 according to an embodiment of the present disclosure.

In an example, if the pitch or amount of overlap 110 is constant, fairly periodic, and quick, the overlap results in a very sharp resonance, as shown by frequency response 402 in FIG. 4. FIG. 4 illustrates frequency responses 402 and 404 associated with the dual axial cable 100 of FIG. 1 according to an embodiment of the present disclosure. Frequency response 402 represents signal loss for differential signal frequencies of the cable 100 with the shield 108 spirally overlapping with a pitch or amount of overlap 110 being constant, fairly periodic, and quick. For example, frequency response 402 shows high signal loss at resonant frequencies of around 15 GHz. In an example, the high signal loss may be around −100 dB as represented by frequency response 402. One of ordinary skill in the art would recognize that −100 dB is merely an example of a possible loss, and that an actual amount of loss may be less or greater than −100 dB based on material and fabrication variations and tolerances of a dual axial cable.

Referring back to FIG. 3, the resonance frequency caused by overlap 110 may be calculated by equation 1 below:

$$f=n/2t_{delay}\ n=1,2,\ldots \qquad \text{EQ. 1}$$

In equation 1, $t_{delay}=p/v$, where p is the pitch distance between sections of the foil wrap, and v is the speed of the signal traveling along cable 100. Thus, the resonance frequency, f, may be determined based on the pitch of the overlap and the number of repetitions.

In an example, by controlling the repetitive nature of the spiral foil wrap of shield 108, both the resonance intensity and the resonance frequency generated by overlap 110 may be changed. The foil wrap of shield 108 may be wrapped around wire conductors 102, insulators 104, and drain wires or conductors 106 in any suitable manner. For example, each spiral or section of the foil wrap for shield 108 may overlap the previous section to form shielding overlap 110 portion or pitch. In certain examples, an amount of overlap 110 or pitch from one foil wrap section to the next adjacent section may be controlled in any suitable manner. For example, a periodic repetitive nature of the spiral foil wrap may be controlled to vary the amount of pitch of overlap 110.

In certain examples, the periodicity of pitch of overlap 110 may be varied in any suitable manner including, but not limited to, a sinusoidal manner and a wave manner. In an example, changing the periodicity of pitch of overlap 110 may create an overall smaller periodicity in the foil wrap, which in turn may create fewer repetitions. The fewer repetitions of the overlap pitch of overlap 110 may drastically reduce the resonance intensity as compared to a shield that is formed with a constant repetition of overlap pitches as shown in FIG. 4.

Referring back to FIG. 4, frequency response 404 represents signal loss for differential signal frequencies of cable 100 with the shield 108 spirally overlapping and the pitch of overlap 110 varying in any suitable manner. For example, frequency response 404 shows that variation of the pitch of overlap 110 makes the resonance intensity and resonance frequency less in dual axial cable 100, as compared to the pitch or amount of overlap 110 being constant, fairly periodic, and quick as illustrated by frequency response 402.

Referring back to FIG. 3, the formulation of frequencies created by the varying pitch of overlap 110 is illustrated by equations 2, 3, and 4 below:

$$f_1=n_1/2t_{d1}\ n_1=1,2,\ldots \quad \text{EQ. 2}$$

$$f_2=n_2/2t_{d2}\ n_2=1,2,\ldots \quad \text{EQ. 3}$$

$$f_3=n_3/2t_{d3}\ n_3=1,2,\ldots \quad \text{EQ. 4}$$

In equation 2, $t_{d1}=p_1/v$, where $p_1$ is the pitch frequency, and v is the speed of the signal traveling along cable 100. In equation 3, $t_{d2}=p_2/v$, where $p_2$ is the pitch frequency, and v is the speed of the signal traveling along cable 100. In equation 4, $t_{d3}=p_3/v$, where $p_3$ is the pitch frequency, and v is the speed of the signal traveling along cable 100.

In an example, the sinusoidal or wave manner of the periodicity of pitch of overlap 110 may be controlled in any suitable manner including, but not limited to, the speed that the foil wrap is wrapped around cable 100. For example, a speed the assembly is fed through a wire wrapping machine may remain constant while the speed the foil wrap for shield 108 is wrapped may be increased or decreased to change the pitch of the overlap from one section to the next. In an example, the sinusoidal variation of the pitch of overlap 110 may be created by modulating a wire feed rate and using a constant wrap rate. The wave variation of the pitch of overlap 110 may be created by linearly increasing and then linearly decreasing the wire feed rate and using a constant wrap rate.

In an example, lower repetitions of the periodicity may reduce the intensity of the resonance and may be further dampened by loss in the channel. Higher frequency harmonics of the resonances frequency may be controlled and shifted out of the frequency of interest for the signals traveling along cable 100.

Figure 5:
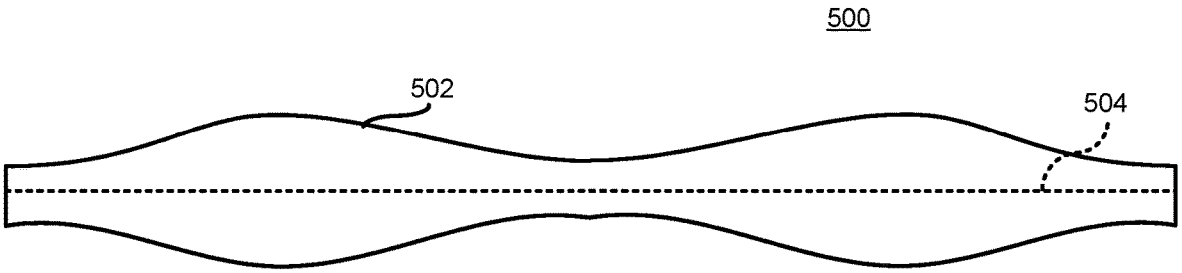
FIG. 5 is schematic top view of a foil wrap according to an embodiment of the present disclosure.
Figure 6:
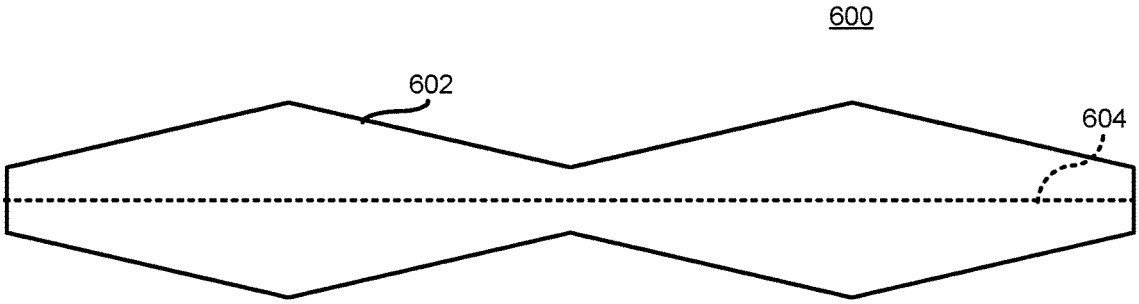
FIG. 6 is schematic top view of a foil wrap according to an embodiment of the present disclosure.

In an example, the foil wrap may be formed to include a variation in the width as shown in FIGS. 5 and 6. In this example, the speed cable 100 is fed through the wire wrapping machine may remain constant and the speed of wrapping the foil wrap may also remain constant.

FIG. 5 is schematic top view of a foil wrap 500 according to an embodiment of the present disclosure. In an example, foil wrap 500 may vary in width in a sinusoidal manner 502 based on a center line 504. In certain examples, the width variation 502 of foil wrap 500 may be any length including, but not limited to, several wraps around a cable, such as cable 100. In this example, the pitch of an overlap, such as overlap 110, between sections of foil wrap 500 may remain constant. However, width variations 502 from center line 504 may result in the sinusoidal manner of the periodicity of the pitch of overlaps in a shield, such as shield 108.

FIG. 6 is schematic top view of a foil wrap 600 according to an embodiment of the present disclosure. In an example, foil wrap 600 may vary in width in a wave or triangular manner 602 based on a center line 604. In certain examples, the width variation 602 of foil wrap 600 may be any length including, but not limited to, several wraps around a cable, such as cable 100. In this example, the pitch of an overlap, such as overlap 110, between sections of foil wrap 600 may remain constant. However, width variations 602 from center line 604 may result in the wave manner of the periodicity of the pitch of overlaps in a shield, such as shield 108.

Figure 7:
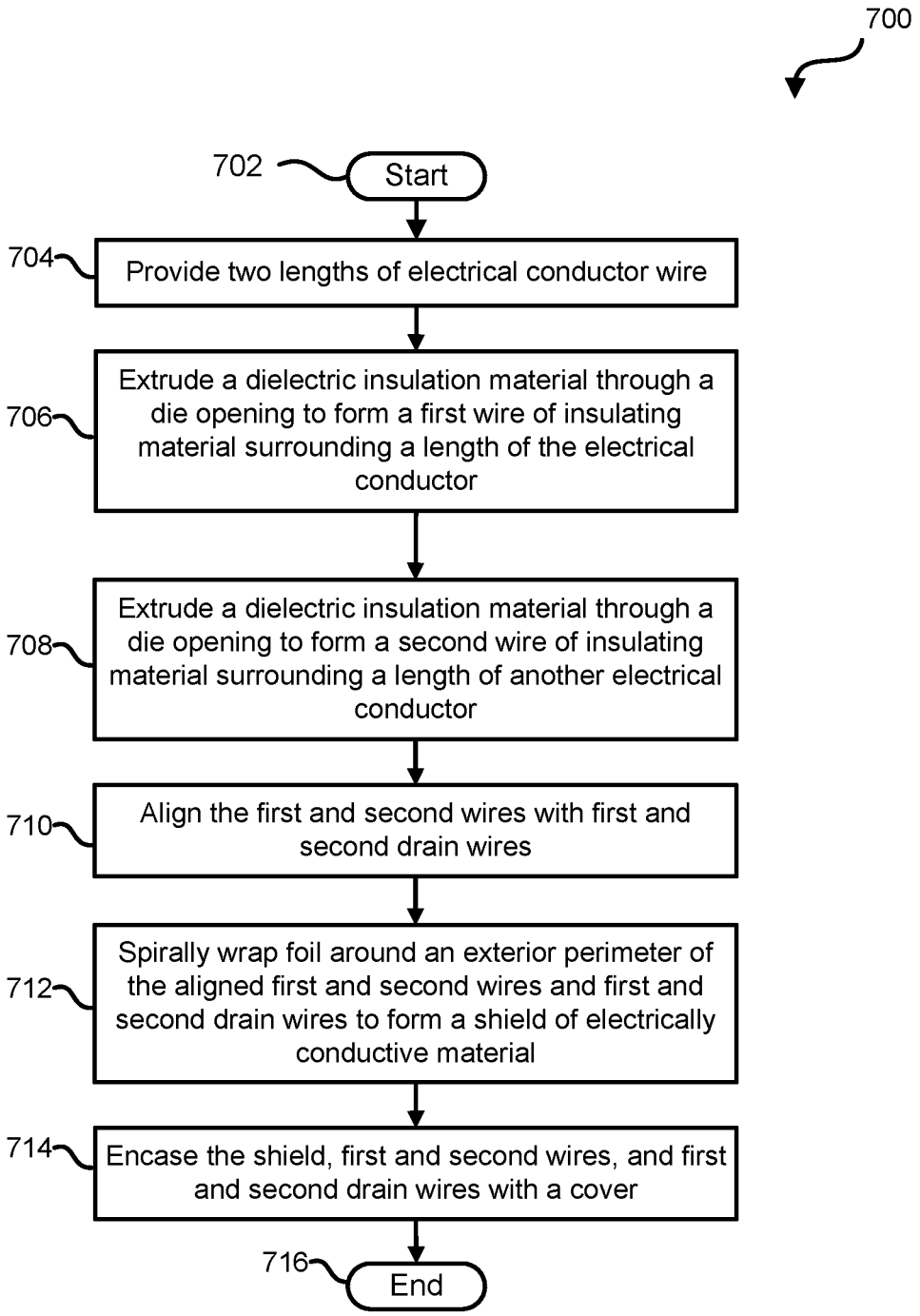
FIG. 7 illustrates a flow chart of a method for creating a dual axial cable with spiral shielding according to an embodiment of the present disclosure.

FIG. 7 illustrates a flow diagram of a method 700 for creating a dual axial cable with spiral shielding according to at least one embodiment of the disclosure, starting at block 702. It will be readily appreciated that not every method step set forth in this flow diagram is always necessary, and that certain steps of the methods may be combined, performed simultaneously, in a different order, or perhaps omitted, without varying from the scope of the disclosure. FIG. 7 may be employed in whole, or in part, an information handling system or any other type of system, controller, device, module, processor, or any combination thereof, operable to employ all, or portions of, the method of FIG. 7.

At block 704, two lengths of electrical conductor wire are provided. In an example, the lengths of electrical conductor wire may be any suitable length. In certain examples, both lengths of wire may be substantially similar lengths. At block 706, a dielectric insulation material is extruded through a die opening to form first wire of insulating material surrounding a length of a first electrical conductor. In an example, the dielectric insulation material may be any suitable material including, but not limited to, polyethylene (PE). At block 708, a dielectric insulation material is extruded through a die opening to form second wire of insulating material surrounding a length of a second electrical conductor.

At block 710, the first and second wires are aligned with one another, and are further aligned with first and second drain wires. In an example, the alignment among the wires and drain wires may be any suitable alignment including, but not limited to, planar alignment of the lengthwise drain wires and electrical conductors of the first and second wires. In certain examples, the first and second wires are adjacent and substantially parallel to each other. In an example, the first and second drain conductors run adjacent and substantially parallel to the first and second electrical conductors, respectively, forming a dual axial cable.

At block 712, a foil wrap is spirally wrap around an exterior perimeter of the assembly of the first and second wires and the first and second drain conductors to form a shield of electrically conductive material. In an example, the foil wrap may be wrapped around the first and second wires and the first and second drain conductors in any suitable manner. For example, each spiral or section of the foil wrap may overlap the previous section to form a shielding overlap portion or pitch. In an example, each overlap of the foil wrap sections may create one or more resonance frequencies based on each gap at a respective overlap in the foil wrap creating an inductor/capacitor (LC) circuit. In certain examples, an amount of overlap or pitch from one foil wrap section to the next adjacent section may be controlled in any suitable manner. For example, a periodic repetitive nature of the spiral foil wrap may be controlled to vary the amount of overlap or pitch. In an example, the controlling or varying of the repetitive nature of the spiral foil wrap may change the resonance intensity and the resonance frequency created by the overlap.

In certain examples, the periodicity of the overlap or pitch may be varied in any suitable manner including, but not limited to, a sinusoidal manner and a wave manner. In an example, changing the periodicity of the pitch may create an overall smaller periodicity in the foil wrap, which in turn may create fewer repetitions. The fewer repetitions of the overlap pitches may drastically reduce the resonance intensity as compared to a shield that is formed with a constant repetition of overlap pitches. In an example, the sinusoidal or wave manner of the periodicity may be controlled in any suitable manner including, but not limited to, the speed that the foil wrap is wrapped around the assembly of the first and second wires and the first and second drain conductors, and a shape of the foil wrap. For example, a speed the assembly is fed through a wire wrapping machine may remain constant while the speed the foil wrap is wrapped may be increased or decreased to change the pitch of the overlap from one section to the next. Alternatively, the foil wrap may be formed to include a sinusoidal or triangle variation in the width. In this example, the speed the assembly is fed through the wire wrapping machine and the speed of wrapping the foil wrap may both remain constant.

At block 714, the shield and assembly of drain conductors and wires is encased with a cover and the method ends at block 716. In an example, the cover may be any suitable material including, but not limited to, a polyester (polyethylene terephthalate (PET)) material.

In the above described flow chart of FIG. 7, one or more of the methods may be embodied in an automated manufacturing controller that performs a series of functional processes. In some implementations, certain steps of the methods are combined, performed simultaneously or in a different order, or perhaps omitted, without deviating from the scope of the disclosure. Thus, while the method blocks are described and illustrated in a particular sequence, use of a specific sequence of functional processes represented by the blocks is not meant to imply any limitations on the disclosure. Changes may be made with regards to the sequence of processes without departing from the scope of the present disclosure. Use of a particular sequence is therefore, not to be taken in a limiting sense, and the scope of the present disclosure is defined only by the appended claims.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A dual axial cable comprising:

first and second signal conductors to transmit a differential signal; and a shield including a foil wrap spirally wrapped around the first and second conductors to form a plurality of foil wrap sections, each of the foil wrap sections overlapping an adjacent foil wrap section, a periodicity of a pitch of each of the overlaps varying along a length of the dual axial cable, wherein the pitch of each of the overlaps is an amount of overlap from one of the foil wrap sections to a next adjacent foil wrap section.

2. The dual axial cable of claim 1, wherein each of the pitches among the overlaps produces a respective resonance frequency.

3. The dual axial cable of claim 2, wherein the variance of the pitches among the overlaps produces fewer repetitions of the same resonance frequency as compared to the pitches of the overlaps being constant along the length of the dual axial cable.

4. The dual axial cable of claim 3, wherein fewer repetitions of the same resonance frequency reduces an intensity of the each resonance frequency as compared to the pitches of the overlaps being constant along the length of the dual axial cable.

5. The dual axial cable of claim 1, wherein the periodicity of pitches among the overlaps is varied based a feed rate of the first and second conductors during a wrapping of the dual axial cable.

6. The dual axial cable of claim 1, wherein the periodicity of pitches among the overlaps is varied based on a width of the foil wrap varying along a length of the foil wrap.

7. The dual axial cable of claim 6, wherein the width of the foil wrap varies as a sinusoidal function over the length of the foil wrap.

8. The dual axial cable of claim 6, wherein the width of the foil wrap varies as a triangle ramp function over the length of the foil wrap.

9. The dual axial cable of claim 1, wherein the periodicity of pitches among the overlaps varies in a sinusoidal manner.

10. The dual axial cable of claim 1, wherein the periodicity of the pitches among the overlaps varies in a wave manner.

11. A method comprising:

feeding first and second signal conductors of a dual axial cable through a foil wrapping machine, the first and second conductors to transmit a differential signal; and spirally wrapping, by the foil wrapping machine, a foil around the first and second conductors to form a shield for the dual axial cable, wherein the spirally wrapping forms a plurality of foil wrap sections, each of the foil wrap sections overlapping an adjacent foil wrap section, a periodicity of a pitch of each of the overlaps varying along a length of the dual axial cable, wherein the pitch of each of the overlaps is an amount of overlap from one of the foil wrap sections to a next adjacent foil wrap section.

12. The method of claim 11, further comprising:

during the wrapping of the dual axial cable, changing a feed rate of the first and second conductors to vary the periodicity of pitches among the overlaps during a wrapping of the dual axial cable.

13. The method of claim 11, wherein each of the pitches among the overlaps produces a respective resonance frequency.

14. The method of claim 13, wherein the variance of the pitches among the overlaps produces fewer repetitions of the same resonance frequency as compared to the pitches of the overlaps being constant along the length of the dual axial cable.

15. The method of claim 14, wherein fewer repetitions of the same resonance frequency reduces an intensity of the each resonance frequency as compared to the pitches of the overlaps being constant along the length of the dual axial cable.

16. The method of claim 11, wherein the periodicity of pitches among the overlaps is varied based a width of the foil varying along a length of the foil.

17. The method of claim 11, wherein the periodicity of pitches among the overlaps varies in a sinusoidal manner.

18. The method of claim 11, wherein the periodicity of the pitches among the overlaps varies in a wave manner.

19. A dual axial cable comprising:

first and second signal conductors to transmit a differential signal; and a shield including a foil spirally wrapped around the first and second conductors to form a plurality of foil wrap sections, each of the foil wrap sections overlapping an adjacent foil wrap section, a periodicity of a pitch of each of the overlaps varying along a length of the dual axial cable, wherein each of the pitches among the overlaps produces a respective resonance frequency, wherein the periodicity of pitches among the overlaps is varied based a feed rate of the first and second conductors during a wrapping of the dual axial cable, wherein the pitch of each of the overlaps is an amount of overlap from one of the foil wrap sections to a next adjacent foil wrap section.

20. The dual axial cable of claim 19, wherein the variance of the pitches among the overlaps produces fewer repetitions of the same resonance frequency as compared to the pitches of the overlaps being constant along the length of the dual axial cable, and the fewer repetitions of the same resonance frequency reduces an intensity of each resonance frequency compared to the pitches of the overlaps being constant along the length of the dual axial cable.

* * * * *